United States Patent [19]

Madden

[11] 4,211,459

[45] Jul. 8, 1980

[54] CIRCUIT BOARD INTERCONNECTION APPARATUS

[75] Inventor: James J. Madden, Naperville, Ill.

[73] Assignee: Bell Telephone Laboratories, Incorporated, Murray Hill, N.J.

[21] Appl. No.: 14,877

[22] Filed: Feb. 26, 1979

[51] Int. Cl.[2] ..... H01R 13/54

[52] U.S. Cl. ..... 339/75 MP; 339/176 MF; 339/176 MP

[58] Field of Search ..... 339/74 R, 75 MP, 176 MF, 339/176 MP

[56] References Cited

U.S. PATENT DOCUMENTS

| | | | |
|---|---|---|---|
| 1,966,156 | 7/1934 | Witcher | 339/74 R |
| 2,149,550 | 3/1939 | Richards et al. | 339/74 R |
| 3,430,186 | 2/1969 | Herb et al. | 339/74 R |
| 3,516,046 | 6/1970 | Gettig | 339/176 |
| 3,614,707 | 10/1971 | Kaufmann et al. | 339/176 MF |
| 3,629,787 | 12/1971 | Wilson | 339/176 MF |
| 3,760,334 | 9/1973 | Bridle | 339/176 MF |
| 4,023,877 | 5/1977 | Hennessey et al. | 339/176 MF |
| 4,029,374 | 6/1977 | Nestor et al. | 339/176 MF |
| 4,054,348 | 10/1977 | Stroupe et al. | 339/176 MF |
| 4,057,311 | 11/1977 | Evans | 339/17 M |
| 4,060,295 | 11/1977 | Tomkiewicz | 339/17 LC |
| 4,060,889 | 12/1977 | Zielinski | 339/176 MF |
| 4,087,146 | 5/1978 | Hudson, Jr. | 339/176 MF |

OTHER PUBLICATIONS

IBM Technical Disclosure Bulletin; Feb. 1965; "Flat Cable Connector" vol. 7, No. 9, p. 742.

*Primary Examiner*—John McQuade
*Attorney, Agent, or Firm*—William H. Kamstra

[57] ABSTRACT

Electrical interconnection apparatus for connecting the terminals (30) of an integrated circuit board (15) to corresponding conductors of a flat, flexible cable. A base (10) is provided to hold an intermediate cable (18) end over a rounded flange (13), the cable (18) being cemented to the base (10) underside and flange (13). A force bar (23) pivotably mounted at each end of the base (10) urges the board (15) terminals against the bared cable conductors (19) under the bias of an elongated "V" shaped spring operating against a second flange (12) of the base (10) and a leg (25) of the force bar (23). A second leg (24) of the force bar (23) provides a means under the adjustment of set screws (28) for controlling the pressure exerted by the force bar (23).

10 Claims, 3 Drawing Figures

CIRCUIT BOARD INTERCONNECTION APPARATUS

BACKGROUND OF THE INVENTION

This invention relates to electrical interconnection apparatus and particularly to such apparatus for establishing connections between integrated circuit boards and the like and flat, flexible electrical cables which are microstrip transmission lines.

The introduction of miniaturized integrated circuits in present-day communications and electronics systems has contributed significantly to system cost reduction, reliability, and, importantly, to overall size reduction. These circuits are formed by fabricating many individual electrical components and their interconnections simultaneously on a single silicon chip, as is known. Individually packaged integrated circuits are then mounted on printed wiring boards which then become the basic system circuit modules. Since the integrated circuit interconnections are also miniaturized and, therefore, greatly reduced in length, higher system operating speeds are also achievable. The extent to which the extremely short signal paths within an integrated circuit may be taken advantage of, however, is limited by the signal path lengths and inductance interconnecting the integrated circuit boards and other system elements. In some known system arrangements, individual circuit boards are interconnected by a common flat electrical cable, the conductors of which make contact with particular circuit board terminals. Interconnection apparatus for making the connections between board and cable have in the past thus been designed to maintain to a minimum the length of the electrical paths between the two and this also comprises one of the problems to which the interconnection apparatus of the present invention is directed.

In addition to the requirement of presenting minimum signal path length, interconnection apparatus of the character here contemplated must also ensure positive and reliable electrical connections and be relatively uncomplicated in order to maintain fabrication and operating costs also to a minimum. Finally, the interconnection apparatus must permit the ready insertion of an integrated circuit board and the alignment of its terminals with the cable conductors without the risk of damage or deformation of the board terminals. The latter goal, as is known, is generally achieved when the board insertion force is zero or near zero. Known prior art interconnection apparatus for electrically connecting integrated circuit boards and flat cables fall short in more or lesser degree in meeting the aforementioned and other criteria. One such arrangement disclosed in U.S. Pat. No. 4,054,348 of J. R. Stroupe et al., issued Oct. 18, 1977, for example, requires that apertures be provided in the circuit boards for admitting elements of the connecting apparatus. U.S. Pat. No. 4,023,877 of W. M. Hennessey et al., issued May 17, 1977, discloses connector apparatus in which the cable conductors are threaded through slots provided therefor, the conductors then being urged against the circuit board terminals by a flexible member of a material such as Neoprene, for example.

SUMMARY OF THE INVENTION

The electrical connection of an integrated circuit board and the like and a flat electrical microstrip cable is simplified and facilitated in accordance with this invention in a connector construction which provides for an intermediate connection of a short length of flat cable between the circuit board terminals and the main transmission path cable. The intermediate cable segment is cemented or otherwise affixed to outer faces of an electrically grounded base. The conductors in the cable, being adjacent to the grounded base, become a microstrip transmission line. The base is dimensioned in length to accord with the width of the circuit board and main cable and is of a generally "U" shaped cross-section to present a pair of upwardly extending flanges. One of the flanges is rounded at its end and the intermediate cable segment is dimensioned to be extended over the rounded flange and well into the base slot formed by the flanges, at which end the intermediate cable insulation is stripped to present a cross-wise array of bared portions of the cable conductors.

The circuit board is maintained in an upright position with its terminals in contact with the exposed portions of the intermediate cable conductors by a force bar operating within the base slot. The force bar extends across the base and is of a generally inverted "L" shaped cross-section to present one leg extending over the base slot and over the flattened top face of the other base flange. The other leg of the force bar extends downwardly into the base slot substantially parallel with the rounded base flange. The ends of the latter force bar leg are pivotably mounted at opposite ends of the base to permit an outer knee of the bar to be swung into contact with the upright circuit board. An elongated spring of substantially "V" shaped cross-section acts between the inner face of the flattened flange and the inner surface of the downwardly extending force bar leg to maintain the circuit board firmly clasped between the force bar knee and the end of the intermediate cable. In this manner, the circuit board terminals are brought into firm and positive electrical contact with the exposed intermediate cable conductors. Force bar pressure against the circuit board is adjustable by set screw means operating between the horizontal force bar leg and the flattened base flange.

The other ends of the intermediate cable conductors are bared in preparation for their electrical connection to the main cable with which the circuit board is to be interconnected. In order further to ensure positive electrical connections between the circuit board terminals and the intermediate cable conductors, a transverse nylon insert in the base rounded flange is featured to slightly raise the bared conductors and concentrate the areas of contact at the board terminals.

BRIEF DESCRIPTION OF THE DRAWING

The features and advantages together with the organization and operation of the interconnection apparatus according to the principles of this invention will be better understood from a consideration of the detailed description of one specific illustrative embodiment thereof which follows when taken in conjunction with the accompanying drawing in which.

DETAILED DESCRIPTION

Figure 1:
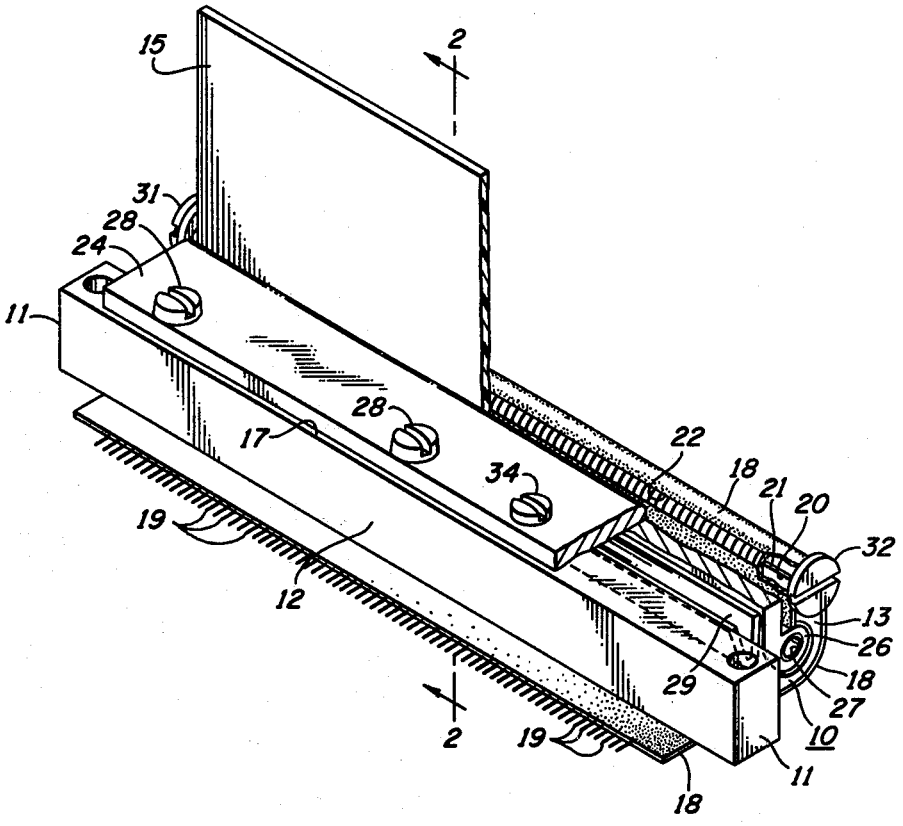
FIG. 1 is a perspective view of an illustrative integrated circuit board interconnection apparatus of the invention having portions broken away more clearly to show the disposition of the parts.
Figure 2:
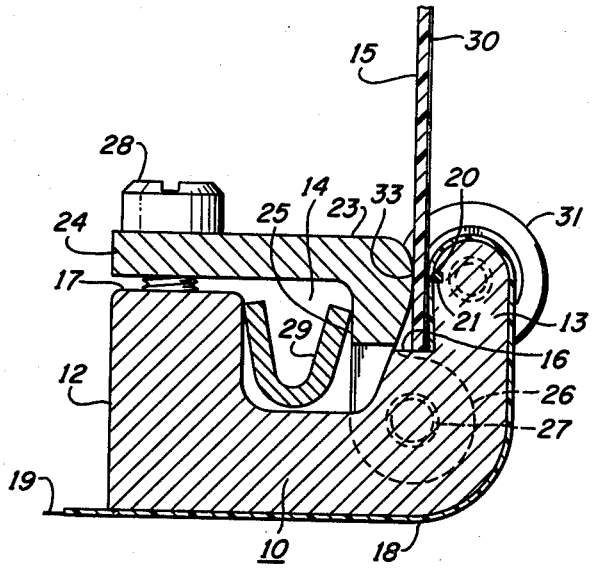
FIG. 2 is an enlarged cross-sectional view of the apparatus of FIG. 1 taken along the line 2–2.

The organization of an integrated circuit board interconnecting apparatus according to this invention is shown generally in FIG. 1, as comprising a base 10 having a pair of apertured mounting lugs 11 at its ends. Base 10 is of a generally "U" shaped cross-section to present a pair of upwardly extending flanges 12 and 13 forming therebetween a slot 14 (FIG. 2). Base 10 is dimensioned lengthwise to accord with the width of a circuit board 15, the disposition of which will be described hereinafter, and the flat, flexible cable (not shown) with which the board 15 is ultimately to be connected. Flange 13 of base 10 is rounded at its end and at its inner side is formed to present a ledge 16 in slot 14. The upper end of the other flange 12 is flattened to present a top face 17 somewhat lower than the rounded end of flange 13. Encircling the underside and the right side of base 10, as viewed in the drawing, and cemented thereto in any suitable manner known in the art, is an intermediate flat conductor cable 18, one end of which extends slightly beyond the other side of base 10 to present a plurality of bared conductors 19. The other end of cable 18 continues and is cemented around and over the rounded end of flange 13 to terminate on the inner side of the latter flange substantially at ledge 16 in slot 14. As shown in FIG. 1 and more clearly in the enlarged section view of FIG. 3, flange 13 is provided with a transverse slot 20 in its inner face in which slot is seated a rib 21 of an insulative material such as nylon, for example. Rib 21 is slightly curved outward from the surface of flange 13 to raise cable 18 in a slight transverse bulge. At this bulge and at the opposite side of cable 18, the insulation is stripped from its conductors to present a conductor contact slot 22.

Extending across the open side of slot 14 of base 10 is an inverted "L" shaped force bar 23. One leg 24 of bar 23 extends over face 17 of flange 12 and a second leg 25 of bar 23 extends downward into slot 14 substantially parallel with flange 13 to terminate at a line just short of the surface of ledge 16. At each end, as exemplified in the foreground of the view of FIG. 1, leg 25 of force bar 23 is extended to present an apertured hinge lug 26 for permitting force bar 23 to pivot about a pair of pintles set in opposite ends of base 10, the end of one, pintle 27, being visible in FIG. 1. The clockwise rotation of force bar 23 is adjustably limited by set screws 28 passing through its leg 24 and set in the flattened surface 17 of base flange 12. Leg 24 of force bar 23 is pivotably urged against set screws 28 by a substantially "V" shaped spring 29 lying in slot 14, the uprights of which spring act against the inner surface of flange 12 and the inner surface of force bar leg 25.

Figure 3:
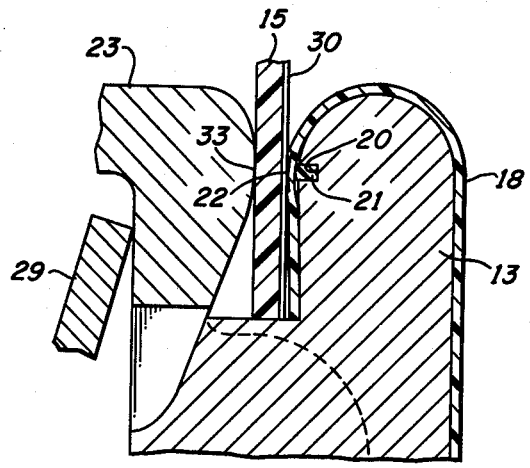
FIG. 3 is a still further enlarged view of a portion of the sectional view of FIG. 2 showing the details of the points of contact of a typical circuit board terminal and a bared cable conductor.

The afore-described interconnection apparatus according to the invention is contemplated in practice as comprising one of a number of such arrangements for interconnecting a plurality of integrated circuit boards and a main flat cable. Accordingly, although not shown in the drawing, it will be assumed for purposes of description that each of the conductors 19 of intermediate cable 18 is electrically connected to an assigned conductor of a main flat cable. The apparatus of the invention is loaded with a circuit board by first forcing force bar 23 to pivot in a counter-clockwise direction against the action of spring 29 by tightening set screws 28. As a result, the gap between the outer surface of force bar leg 25 and the exposed conductors 19 of intermediate cable 18 opens to permit the unimpeded insertion of a circuit board 15 into the aforementioned gap. Board 15 is inserted to ledge 16 with its terminals (one terminal 30, being shown in section view in FIG. 2) facing the bared portions of conductors 19 of cable 18. A pair of adjusting screws 31 and 32 set into each end of base flange 13 maintains the terminals of board 15 and the conductors 19 of intermediate cable 18 in alignment. When board 15 has been fitted as described, set screws 28 are loosened to permit spring 29 to urge force bar 23 to pivot clockwise thereby forcing a transverse knee 33 curving slightly outward on the outer face of leg 25 against the surface of board 15. The latter board is, as a result, firmly clasped between knee 33 and the bared conductors of cable 18, which conductors are slightly raised at this point by the outward pressure of rib 21 (FIG. 3). The compression of spring 29 is determined so that, with set screws 28 fully cleared, only so much pressure is exerted by knee 33 as to clasp firmly board 15 without damage to its surface or its terminals. A stop screw 34 is provided passing through force bar leg 24 and set in flattened surface 17 of flange 12, which screw 34 acts to prevent any ultimate full closure of the unloaded circuit board gap should set screws 28 be inadvertently retracted too far. A circuit board is readily removed from the interconnection apparatus by tightening screws 28 to retract force bar knee 33 from the board. It may be noted that although three screws 28 were assumed as being provided (two of which are visible in FIG. 1), a single such set screw may be adequate in practice to control the setting and release of force bar 23.

What has been described is considered to be only one specific illustrative interconnection apparatus according to this invention. Accordingly, it will be appreciated that various and numerous other arrangements may be devised by one skilled in the art without departing from the spirit and scope of the invention as defined by the accompanying claims.

What is claimed is:

1. Interconnection apparatus comprising a flat, flexible cable (18) having a plurality of conductors, a circuit board (15) having a plurality of terminals (30) corresponding to said plurality of conductors, and a base (10) for supporting said cable and said board and for aligning and connecting said conductors and said terminals characterized in that said base (10) is provided with a slot (14) to present a first and a second flange (13, 12) having opposing faces, and in that a clamping means is provided for clamping the end of said cable between a circuit board (15) and one face of said first flange (13), said clamping means comprising an inverted, substantially "L" shaped force bar (23) pivotally mounted (26, 27) at each end of said base, one leg (25) of said bar having a knee (33) opposite said one face of said first flange (13), spring means (29) operating between the face of said second flange (12) and said one leg (25) of said force bar (23) for urging said knee (33) against said circuit board (15), and means (28) for adjusting the travel of the other leg (24) of said force bar (23) for controlling the force of said knee (33) on said circuit board (15).

2. Interconnection apparatus as claimed in claim 1 further characterized in that said spring means (29) comprises an elongated, substantially "V" shaped member (29) having one upright operating against the inner surface of said second flange (12) and the other upright operating against the inner surface of said one leg (25).

3. Interconnection apparatus as claimed in claims 1 or 2 further characterized in that said flat, flexible cable (18) is cemented to said base (10) over said first flange (13), along the outer face of said first flange (13), and along the underside of said base (10).

4. Interconnection apparatus as claimed in claim 3 further characterized in that said flat cable (18) projects beyond the outer face of said second flange (12) to present bared ends of said conductors (19).

5. Interconnection apparatus as claimed in claim 4 further characterized in that a transverse rib (21) of an insulative material is set in said one face of said first flange (13) for raising a portion of said cable (18) away from said one face of said first flange (13).

6. Interconnection apparatus as claimed in claim 5 further characterized in that adjusting screw means (31, 32) are provided at opposite ends of said first flange (13) for aligning said cable (18) and said circuit board (15).

7. Interconnection apparatus as claimed in claim 6 further characterized in that stop screw means (34) are provided to limit the rotation of said force bar (23) toward said first flange (13).

8. Interconnection apparatus for electrically connecting the conductors of a flat main cable to corresponding terminals of a circuit board comprising a base for supporting said board, said base being slotted to present a first and a second flange having opposing inner faces and opposite outer faces extending from an underside of said base, a flat, flexible intermediate cable affixed to said base extending from the inner face of said first flange, along said outer face of said first flange, and along said underside of said base, to extend beyond said outer face of said second flange, said intermediate cable presenting a first and a second array of bared conductor segments at said inner face of said first flange and beyond said last-mentioned outer face, respectively, said second array of bared conductor segments being adapted for electrical connection to particular bared conductors of said main cable, clamping means for clamping together corresponding terminals of a circuit board and the bared conductor segments of said first array of conductor segments comprising an inverted, substantially "L" shaped force bar pivotably mounted at each end of said base, one leg of said bar having a knee opposite the inner face of said first flange, and spring means operating between the inner face of said second flange and said one leg of said force bar for urging said knee against said circuit board.

9. Interconnection apparatus as claimed in claim 8 in which said spring means comprises an elongated, substantially "V" shaped member having one leg operating against said inner face of said second flange and the other leg operating against said one leg of said force bar.

10. Interconnection apparatus as claimed in claim 9 also comprising means for adjusting the travel of the other leg of said force bar for controlling the force of said knee on said circuit board.

* * * * *